United States Patent [19]

Liverance et al.

[11] Patent Number: 4,533,119

[45] Date of Patent: Aug. 6, 1985

[54] WINCH ASSEMBLY

[76] Inventors: Howard G. Liverance, 13149 Sycamore, Southgate, Mich. 48195; Jack E. Wood, 7644 Plymouth Ann Arbor, Mich. 48105

[21] Appl. No.: 110,620

[22] Filed: Jan. 9, 1980

[51] Int. Cl.[3] ..... B66D 1/12; B66D 1/22; B66D 3/20; B66D 3/26

[52] U.S. Cl. ..... 254/344; 200/51.09; 200/153 K; 254/362

[58] Field of Search ..... 254/344, 362, 297, 316; 242/84.1 A; 414/500

[56] References Cited

U.S. PATENT DOCUMENTS

| | | | |
|---|---|---|---|
| 1,318,568 | 10/1919 | Kittredge | 242/84.1 A |
| 2,247,795 | 7/1941 | Whitcomb et al. | 254/362 |
| 3,116,892 | 1/1964 | Pickard | 242/84.1 A |
| 3,474,922 | 10/1969 | Wood et al. | 414/500 |
| 3,675,870 | 7/1972 | Ride et al. | 242/84.1 A |
| 3,784,165 | 1/1974 | Pruitt | 254/362 |
| 4,236,052 | 11/1980 | Haase | 200/51.09 |

*Primary Examiner*—Billy S. Taylor

*Attorney, Agent, or Firm*—Robert G. Mentag

[57] ABSTRACT

A power winch mechanism having a rotatable cable drum in which is rotatably mounted a D.C. electric drive motor. One end of the cable drum, and one end of the electric drive motor is operatively supported by a fixed support member on a base plate. The other ends of the cable drum and the electric drive motor are rotatably supported by a fixed gear housing, axially spaced apart from the first mentioned fixed support member. The electric drive motor is provided with an elongated output shaft that extends into the fixed gear housing, and it carries a fixedly mounted sun gear that is in mesh with, and drives a pair of planetary gears. The planetary gears are in mesh simultaneously with a fixed ring gear mounted in the fixed gear housing and a rotatable ring gear that is fixed on the cable drum. The rotatable ring gear on the cable drum is provided with two more teeth than the fixed ring gear on the fixed gear housing. The electric drive motor is controlled by a rotating brush assembly and a fixed brush assembly, and a reversible switch assembly.

12 Claims, 11 Drawing Figures

WINCH ASSEMBLY

TECHNICAL FIELD

This invention relates generally to the electric winch art, and more particularly to an improved electric winch mechanism which is constructed and arranged with an electric drive motor mounted within the cable drum of the winch mechanism. The electric winch of the present invention is adapted for use on a boat trailer, for use on aircraft, for use on four-wheel drive vehicles, and as a general utility winch.

BACKGROUND ART

It is known in the power winch art to provide power winch mechanisms for general utility use, and for boat trailer use, and an example of such a winch is shown in U.S. Pat. Nos. 3,474,922 and 3,645,503. A disadvantage of the prior art power winches shown in the aforementioned patents is that they are costly to manufacture, they are large in size, and they are not capable of being installed in a small compact area on a boat trailer, aircraft, four-wheel drive vehicle or the like. A further disadvantage of such power winch mechanisms is that the drive motor is extended axially outward from the cable drum so as to make a large and cumbersome winch mechanism. Attempts have been made heretofore to overcome the last mentioned disadvantage by providing electric drive winches which include an electric drive motor within a cable drum. Examples of the last mentioned electric winch mechanisms are shown in U.S. Pat. Nos. 1,555,094; 1,585,065; 1,738,811; 1,898,753; 2,039,870 and 2,420,072. A disadvantage of the last mentioned prior art winch mechanisms is that they are substantially large in overall construction, and they do not include an efficient gear reduction means between the electric drive motor and the cable drum. A further disadvantage is the fact that they do not include an efficient and fast operating, reversible switch for operating the electric drive motor for the winch.

DISCLOSURE OF THE INVENTION

In accordance with the present invention, a compact and improved electric power winch mechanism is provided which is adapted for many different uses as, for example, a general utitity winch mechanism, a power winch mechanism for a boat trailer, a power winch mechanism for an aircraft, a power winch mechanism for use on a four-wheel drive vehicle, and so forth. The electric power which mechanism of the present invention includes a cable drum or reel which also functions as a motor housing for an electric drive motor that is internally mounted within the cable drum. One end of the cable drum is rotatably supported by a motor end and brush housing support member which is fixedly mounted on a base plate. The last mentioned support member also supports one end of the drive motor. The other end of the drive motor is supported by an axially spaced apart, gear housing which is also fixedly mounted on said base plate.

The electric drive motor includes an armature which is rotatably mounted within the cable drum, and which has an armature that has one end shaft rotatably mounted in the brush housing that is rotatably supported by the end support member. The other end of the motor armature includes an elongated output shaft which is rotatably supported by said gear housing. The elongated output shaft has operatively mounted thereon a sun gear that is meshed with, and drives, a pair of planetary gears. The planetary gears are each in mesh with a fixed internal ring gear that is fixedly mounted in said gear housing, and a rotating gear that is fixed to the cable drum. The rotating ring gear has two more teeth than the fixed ring gear.

The electric drive motor is a D.C. motor that includes a fixed brush assembly which is carried in the stationary brush housing support member, and which is operatively connected to a rotating brush assembly that is mounted in the rotatably supported brush housing. A quick acting and reversible switch assembly is operatively mounted on the fixed brush housing for controlling the direction and operation of the electric drive motor.

The power winch mechanism of the present invention overcomes the disadvantages of the aforementioned prior art winch mechanisms in that it is economical, efficient and compact. The gear reduction unit employed in the power winch mechanism provides an economical and simple gear reduction unit which provides a suitable rotational speed of the cable drum relative to the speed of the electric drive motor. The switch assembly provides an efficient, reversible switch means which also functions to control the electric motor so that it functions with the gear reduction unit to provide an electrical coupling or brake when the winch is in an off position.

BEST MODE OF CARRYING OUT THE INVENTION

Figure 1:
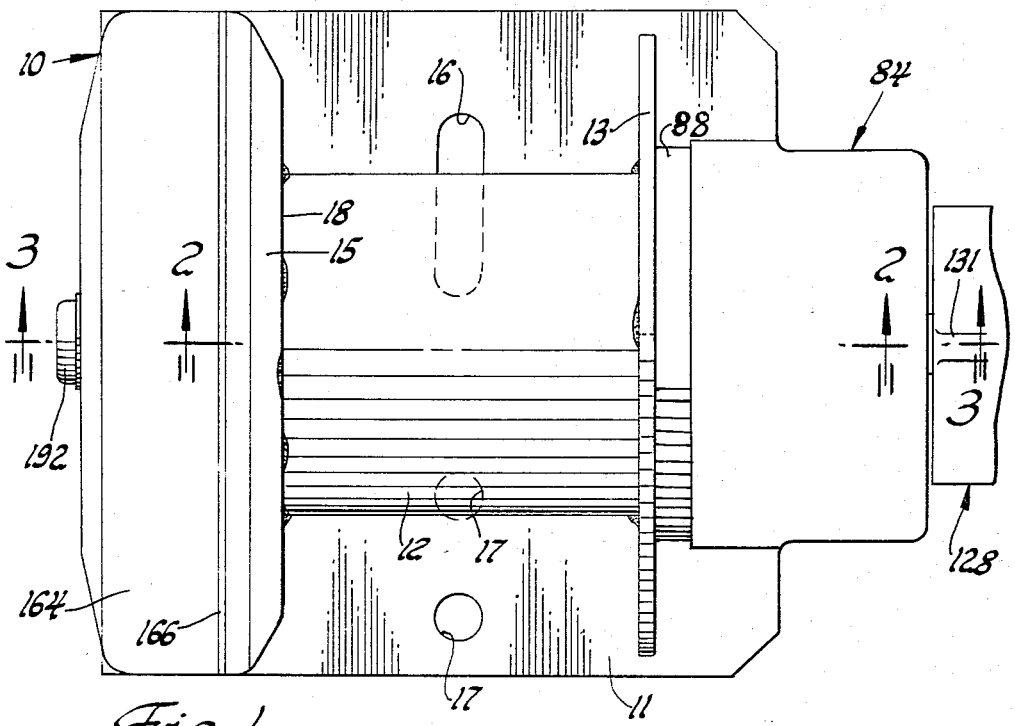
FIG. 1 is a top plan view of an electric motor winch mechanism made in accordance with the principles of the present invention.
Figure 2:
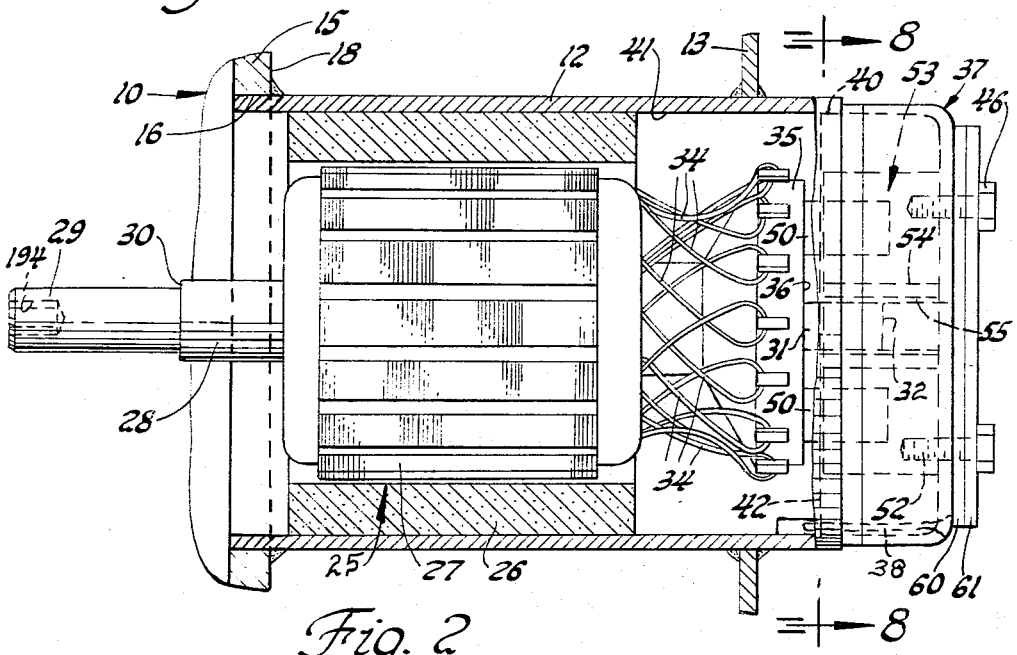
FIG. 2 is a fragmentary, elevational section view of the winch structure illustrated in FIG. 1, with parts removed and parts broken away, taken along the line 2—2 thereof, and looking in the direction of the arrows.
Figure 3:
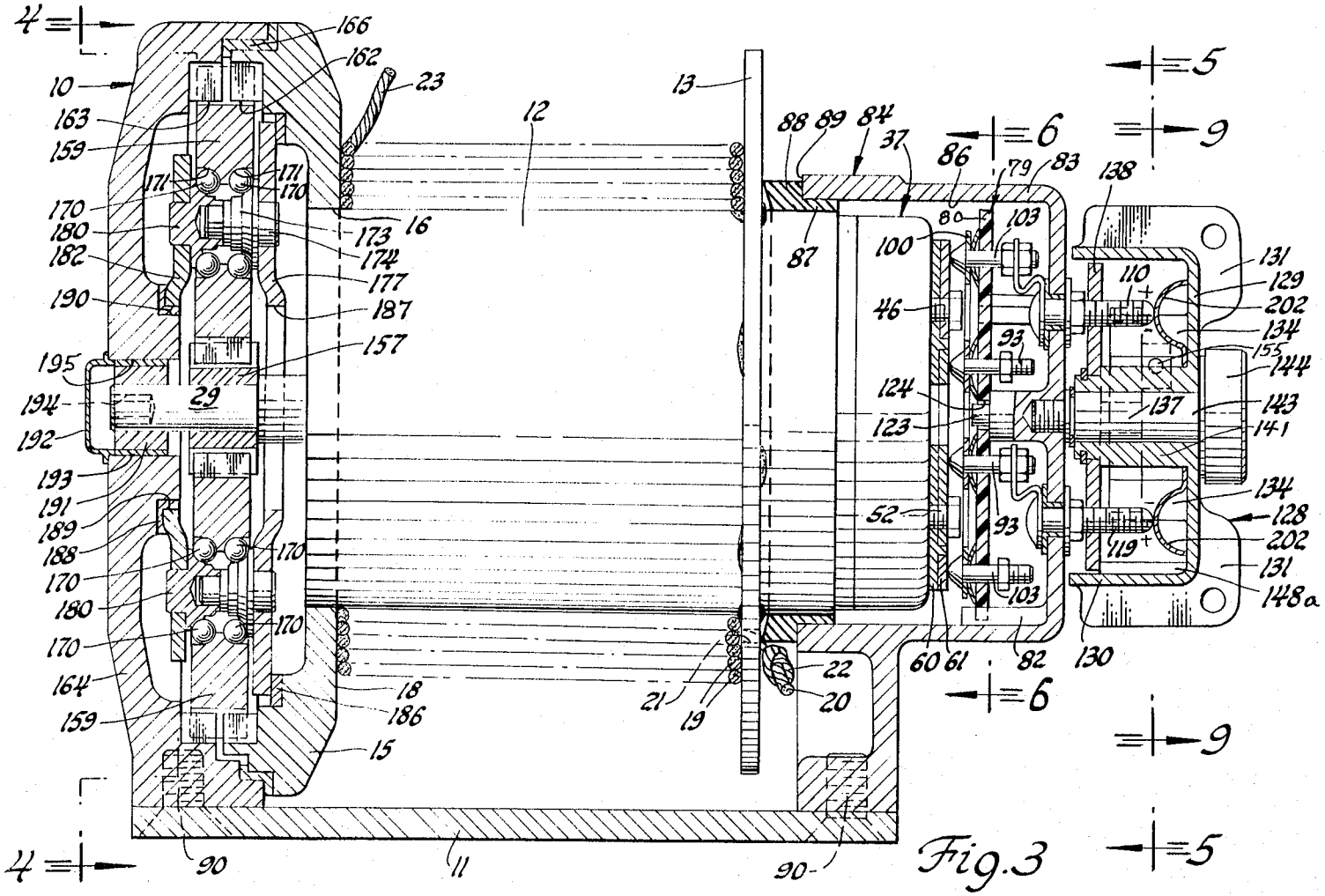
FIG. 3 is an enlarged, elevational section view of the winch structure illustrated in FIG. 1, taken along the line 3—3 thereof, and looking in the direction of the arrows.

Referring now to the drawings, and in particular to FIGS. 1, 2 and 3, the numeral 10 generally designates an electric motor driven winch mechanism made in accordance with the principles of the present invention. As shown in FIGS. 1 and 3, the winch mechanism 10 includes a base plate 11 for mounting the winch mechanism 10 in an operative position on a boat trailer, four wheel drive vehicle, an aircraft, or the like. As shown in FIG. 1, the base plate 11 is provided with apertures 16 and 17 therethrough, for carrying the winch mechanism 10 in position by suitable nut and bolt means. As shown in FIGS. 1, 2 and 3, the winch mechanism 10 includes a rotatable cable reel for cable drum 12 which has a flange 13 fixedly mounted on one end thereof by any suitable means, as by welding.

Figure 5:
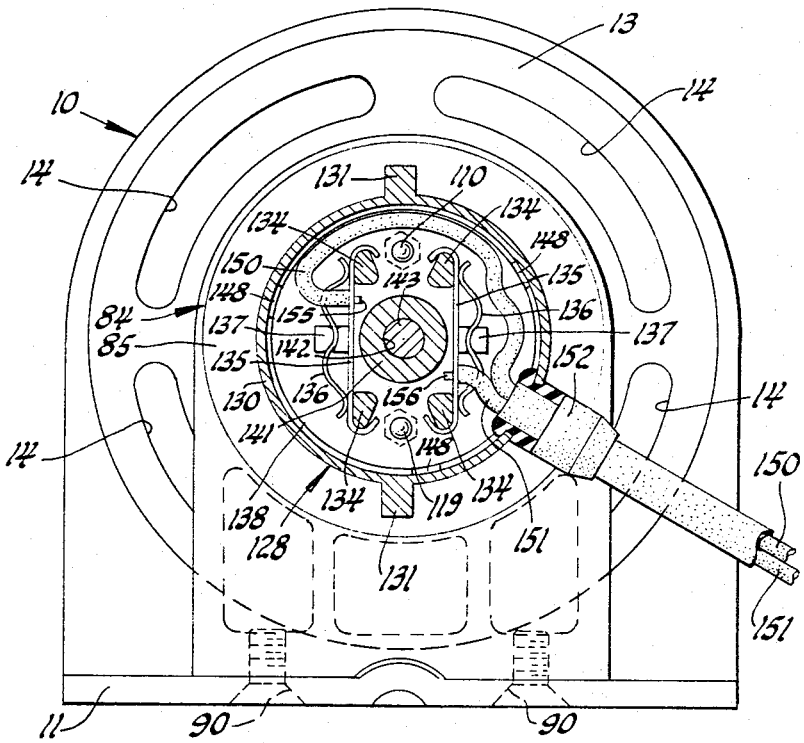
FIG. 5 is a reduced, right end section view of the power winch mechanism illustrated in FIG. 3, taken along the line 5—5 thereof, and looking in the direction of the arrows.

As shown in FIG. 5, the flange 13 is an annular flange and it is provided with equally spaced, arcuate slots 14. As shown in FIGS. 1 and 3, the cable drum 12 is provided with an annular gear housing 15 on the other end thereof which is fixedly secured to the drum 12 by any suitable means as by welding. The inner face 18 of the gear housing 15 functions as a second cable flange. As shown in FIG. 3, a suitable cable 19 is operatively wound around the cable drum 12 and one end 20 thereof is operatively mounted through a hole 21 in the flange 13 and it is knotted as indicated by the numeral 22 to prevent cable end 20 from slipping back through the hole 21. The free end of the cable 19 is indicated by the numeral 23 in FIG. 3. It will be understood that the cable 19 may be made of any suitable material and it would be made to a strength commensurate with the size of the particular winch mechanism in which it is mounted.

As shown in FIG. 2, a D.C. electric motor generally indicated by the numeral 25 is operatively mounted in the cylindrical chamber 41 formed inside of the cable drum 12. The electric motor 25 may be of any suitable type which may be modified to function with the hereinafter described gear reduction unit, brush assemblies, and reversible switch means. A suitable electric motor is one that is on the market and available from American Bosch of 3700 Main St., Springfield, Mass., under model number 551030A. As shown in FIG. 2, the electric motor 25 includes a semi-circular permanent magnet 26 which is mounted in the chamber 41 and attached to the cable drum 12 by any suitable means, as by an adhesive. A rotatable armature 27 is mounted within the semi-circular permanent magnet 26. An output shaft 28 extends outwardly from the armature 27 to the left end thereof as viewed in FIG. 2. The output shaft 28 has a reduced diameter shaft extension 29 which forms a shoulder 30 with the shaft 28. The armature shaft 28 extends outwardly through a circular opening 16 formed through the gear housing 15. As shown in FIG. 2, the armature 27 is provided on the right end thereof with a support shaft 31 and the outer end thereof is indicated by the numeral 32. The numerals 34 in FIG. 2 designate the usual armature conductors which are operatively connected to a commutator 35. The numeral 36 in FIG. 2 designates the commutator surface which is operatively engaged by a pair of brushes 44 and a pair of brushes 50 (FIG. 8) which are operatively mounted in a brush assembly generally indicated by the numeral 37 which is rotatable with the cable drum 12. As shown in FIG. 2, the rotating brush assembly 37 is secured to the cable drum 12 by any suitable means, as by suitable attachment screws 38. The cable drum 12 is cylindrical and open at each end and the rotating brush assembly is operatively mounted on the right end of the cable drum 12 as viewed in FIG. 2.

Figures 6, 7, 8, 9:
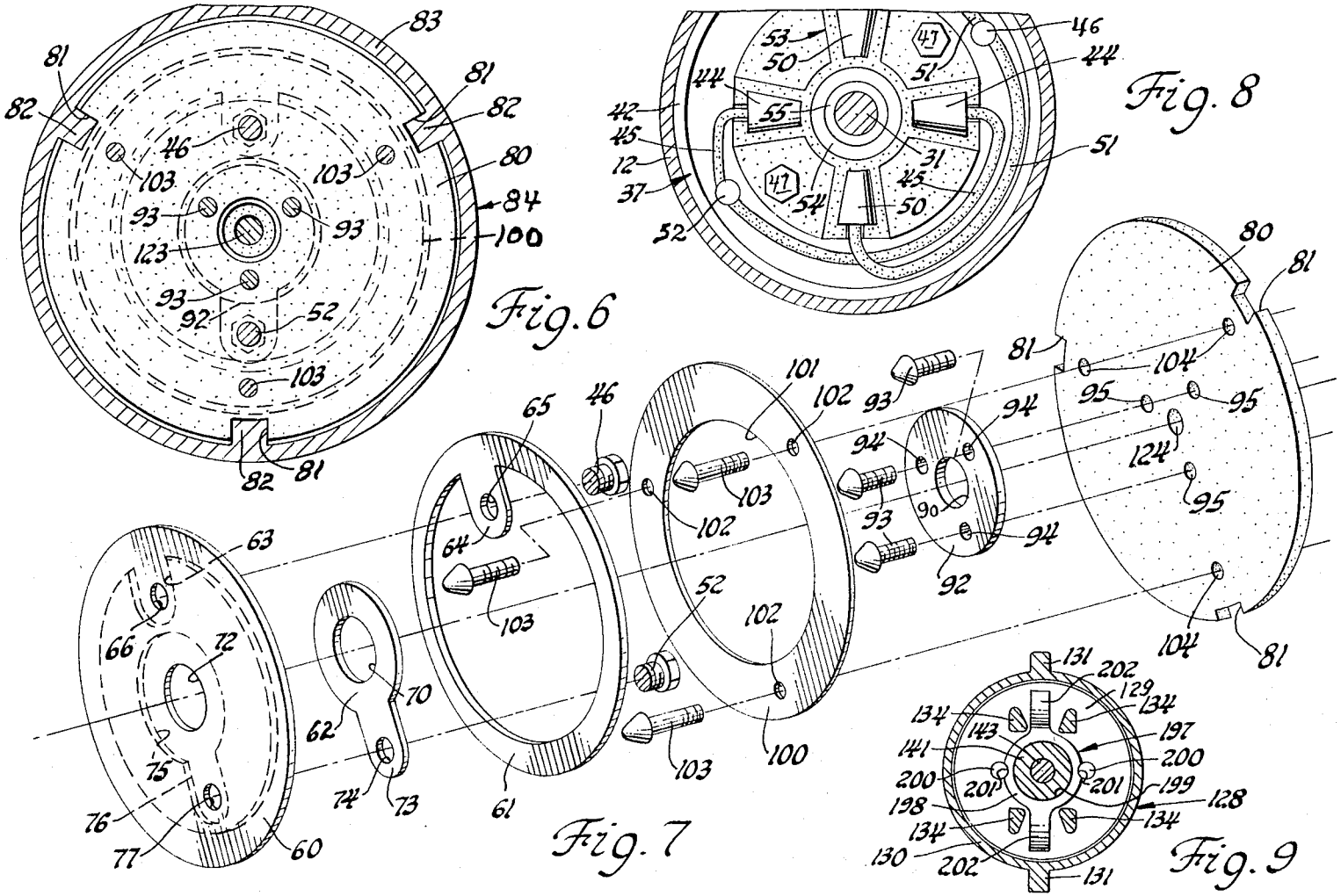
FIG. 6 is an elevational section view of the power winch mechanism illustrated in FIG. 3, taken along the line 6—6 thereof, and looking in the direction of the arrows.
FIG. 7 is an exploded view of the outer brush assembly.
FIG. 8 is a fragmentary, elevational section view of the power winch mechanism illustrated in FIG. 2, taken along the line 8—8 thereof, looking in the direction of the arrows, and showing the inner rotating brush assembly.
FIG. 9 is a reduced, elevational section view of the switch structure for the power winch mechanism illustrated in FIG. 3, taken along the line 9—9 thereof, and looking in the direction of the arrows.

The inner end of the housing of the brush assembly 37 has a reduced diameter shoulder 40 which is slidably mounted within the chamber 41 of the cable drum 12. The inner end of the housing of the brush assembly 37 is indicated by the numeral 42 in FIG. 2. As shown in FIG. 8, the brushes 44 and 50 are operatively mounted in a suitable brush retainer, generally indicated by the numeral 53. The brush retainer 53 is fixedly secured to the housing of the brush assembly 37 by any suitable means as by suitable screws 47. The brush retainer 53 is co-axially mounted on a hub 54 on the housing 37 which is tubular and carries a bushing 55 in which is rotatably mounted the armature shaft 31 (FIG. 2).

As shown in FIG. 8, the pair of brushes 44 are oppositely disposed on opposite sides of the armature shaft 31 on a first plane, and the pair of brushes are similarly disposed on a plane perpendicular to the plane of the brushes 44. The two brushes 44 are operatively connected by suitable conductors 45 to a first terminal 52 which is formed as a screw as shown in FIG. 2. The two brushes 50 are similarly connected by conductors 51 to a second oppositely disposed terminal screw 46.

Figure 3B:
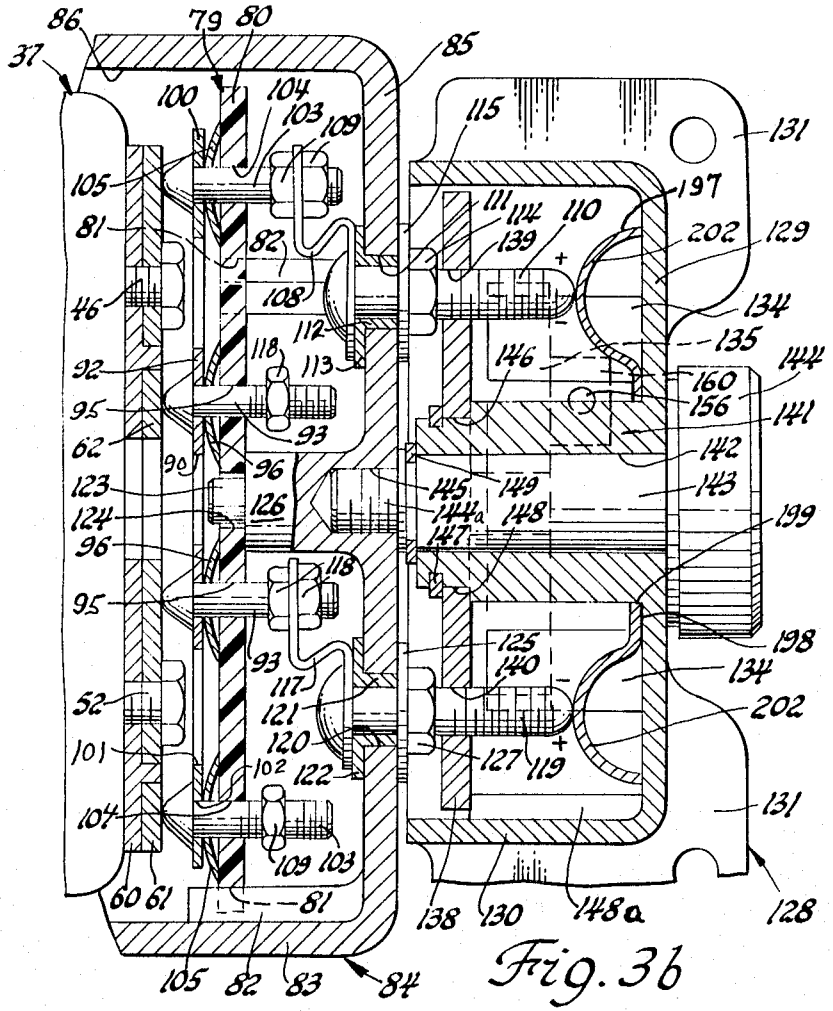
FIG. 3*b* is an enlarged view of a portion of the right end of FIG. 3.

As shown in FIGS. 3 and 3*b*, an insulating plate 60 made from a suitable molded plastic is seated against the outer end surface of the brush housing for the rotatable brush assembly 37. The insulator plate 60 has secured thereto a pair of concentric contact plates 61 and 62 (FIG. 7). As shown in FIG. 7, the outer contact plate 61 has an inwardly extended attachment portion 64 which has a bore 65 formed therethrough. The outer contact plate 61 is circular and ring shaped and it is seated around a central portion of the insulating plate 60. The inward extension 64 on the contact plate 61 is adapted to be seated in a recess 63 formed in the insulating plate 60. Insulating plate 60 has a hole 66 formed therethrough. It will be seen that the terminal screw 46 passes through the hole 65 in the contact plate portion 64 and through the hole 66 of the insulating plate 60 and into threaded engagement with the housing of the brush assembly 37 (FIG. 3).

As shown in FIG. 7, the inner contact plate 62 is ring shaped with an axial bore 70 formed therethrough. The contact plate 62 has an outwardly extended attachment portion or tongue 73 which has a hole 74 formed therethrough. As shown in FIG. 7, the insulating plate 60 has a central recess 75 in which is seated the contact plate 62. An outwardly extended recess 76 is connected with the recess 75 and the insulating plate 60 for reception of the contact plate tongue 73. The insulating plate 60 has a central hole 72 which is aligned with the central hole 70 through the contact plate 62. The insulating plate 60 also has a hole 77 formed therethrough. The terminal screw 52 is adapted to pass through the holes 74 and 77 in the contact plate 62 and insulating plate 60 for securing these members to the housing of the rotatable brush assembly 37.

As shown in FIGS. 3 and 3*b*, the outer and inner contact plates 61 and 62 are operatively engaged by a fixedly mounted brush assembly generally indicated by the numeral 79. The brush assembly 79 includes a circular retaining insulator plate 80 which is made from any suitable material, as for example, a rigid plastic material. The retaining insulator plate 80 is operatively mounted within a motor end housing support member generally indicated by the numeral 84. The support member 84 includes a cylindrical housing 83 which is open at the inner end and closed at the outer end by an end wall 85. The cylindrical chamber 86 which is formed within the housing wall 83, receives in its left open end, the right end (FIG. 3) of the cable drum 12 and the rotatable brush assembly 37. As best seen in FIG. 6, the retaining insulator plate 80 is provided with a plurality of notches 81 at evenly spaced positions around the periphery thereof which are adapted to be slidably mounted over a plurality of axially extended retainer ridges 82 that are integrally formed on the inner surface of the housing wall 83.

As shown in FIG. 3, the right end of the cable drum 12 is rotatably mounted within the inner open end of the support housing member 84 by a suitable bushing or bearing 87 which has a peripheral outwardly extended flange 88 that abuts the end face 89 of the housing wall 83. As shown in FIGS. 3*b*, 6 and 7, the retaining insulator plate operatively carries a pair of conductor plates 92 and 100. The conductor plate 92 is an inner conductor plate and the conductor plate 100 is an outer conductor plate. The conductor plates 61, 62, 92 and 100, are all made from any suitable conductive material as for example, brass. The inner conductor plate 92 is provided with a plurality of evenly spaced holes around an axial hole 90. A plurality of contact buttons 93 having conically shaped heads and threaded shafts are extended through the holes 94 and through mating holes 95 in the insulator plate 80. A suitable spring washer 96 is mounted around each of the contact buttons 93 between the conductor plate 92 and the insulator plate 80. The contact buttons 93 are made from any suitable material, as from brass, and they are secured from moving out of the bores 95 in the insulator plate 80 by suitable nuts 118.

As shown in FIGS. 3*b* and 7, the outer conductor plate 100 is ring shaped and has an opening 101 formed axially therethrough. The conductor plate 100 is provided with a plurality of evenly spaced holes 102 for the reception of the threaded shafts of a plurality of contact buttons 103 which are formed similar to the contact buttons 93. As shown in FIG. 3*b*, the threaded bodies of the contact buttons 103 are slidably mounted through mating bores 104 formed through the insulating plate 80, and they are retained from sliding out of the bores 104 by suitable nuts 109. Suitable spring washers 105 are operatively mounted around the shafts of each of the contact buttons 103 between the conductor plate 100 and the insulating plate 80. It will be seen that the spring washers 96 and 105 normally bias the conductor plates 92 and 100, and the contact buttons 93 and 103 to the left as viewed in FIG. 3, so as to maintain the contact buttons 93 and 103 in operative engagement with the inner and outer contact plates 62 and 61, respectively.

As shown in FIG. 3*b*, the outer conductor plate 100 is electrically connected with a first terminal screw 110 by means of a ribbon spring conductor 108. One end of the spring conductor 108 is secured by a pair of nuts 109 to one of the contact buttons 103. As shown in FIG. 3*b*, the terminal screw 110 has a head formed on the inner end thereof, and the body of the screw extends through a bushing 112 which is operatively mounted to a bore 111 that is formed through the end wall 85 of the housing 84. The bushing 112 is provided with a flange 113. The bushing 112 may be made from any suitable molded plastic. The terminal screw 110 is secured in position by a suitable washer 115, and lock nut 114.

The inner conductor plate 92 is electrically connected to a second terminal screw 119 by a ribbon spring conductor 117. As shown in FIG. 3*b*, one end of the spring conductor 117 is fixed by suitable nuts 118 to one of the contact buttons 93. The other end of spring conductor 117 is secured to the terminal screw 119. The terminal screw 119 is provided with a head on its inner end and the body thereof is extended through a suitable molded plastic bushing 121 which is operatively mounted through a bore 120 that is formed through the end wall 85 of the housing 84. The terminal screw 119 is held in position by a suitable washer 125 and a lock nut 127.

The housing 84 is provided with an integral, axial shaft 126 which has a reduced diameter shaft extension 123 that extends through the axial hole 124 formed through the insulator plate 80 for piloting and locating the insulator plate 80. The insulator plate 80 is seated against the shoulder formed by the junction of the reduced diameter shaft portion 123 with the larger diameter shaft 126.

The flow of D.C. electric current to the electric motor 25 is adapted to be operatively controlled by a reversible switch generally indicated by the numeral 128 in FIGS. 3, 3*b* and 5. As best seen in FIG. 3*b*, the switch assembly 128 includes a cylindrical housing or body 30 which is open at the inner end and which is enclosed at the outer end by an end wall 129. A pair of oppositely disposed flanges 131 are integrally formed on the housing walls 129 and 130 in opposite diametrical and aligned positions for manual rotation of the switch assembly 128. As best seen in FIGS. 5 and 9, the switch assembly 128 is provided with four inwardly extended integral lugs 134. A pair of the lugs 134 are aligned on opposite sides of the rotational axis of the switch housing and each pair of lugs 134 has an elongated brass contact plate 135 mounted therebetween. The ends of each of the contact plates 135 are curved so as to be mounted around the outer ends of the members 134. As shown in FIG. 5, the contact plates 135 are biased into seating engagement with the members 134 by a pair of wave springs 136. The wave springs 136 are each operatively mounted in a slot formed in a pair of projections 137 that are integrally formed on a circular carrier plate 138. The carrier plate 138 is made from suitable insulating material. The housing for the switch assembly 128 would also be made from a suitable insulating material. As shown in FIG. 3*b*, the terminal screws 110 and 119 are mounted through suitable holes 139 and 140 formed through the carrier plate 138.

As shown in FIGS. 3*b* and 5, an integral, axial hub 141 is formed on the inside of the switch housing wall 129 and it extends toward the brush housing 84. The hub 141 has an axial bore 142 formed therethrough in which is mounted the switch assembly mounting screw 143. The mounting screw 143 is provided with a knurled head 144. The screw 143 is provided with a reduced diamter, threaded inner end portion 144*a* which is threadly mounted in a threaded bore 145 that is formed in the shaft 126 in the housing 84.

The shaft or hub 141 is provided with a reduced diamter portion 148 which is rotatably mounted in a bore 146 formed through the insulator plate 138. The plate 138 is retained on the shaft 141 by a suitable retainer ring 147. The mounting screw 143 is retained in the bore 142 by a suitable retainer ring 149. The insulating plate 138 abuts a plurality of integral ribs 148*a* which are formed in evenly spaced positions around the inner wall of the switch housing wall 130.

As shown in FIG. 9, the switch assembly 128 includes a shunting strip generally indicated by the numeral 197 which is made from a suitable conductive material, as for example, spring steel. The shunting strip 197 includes a circular body portion 198 which is provided with a bore 199 therethrough for mounting said body portion 198 around the shaft 141 on the inner end of the switch housing wall 129. As shown in FIG. 9, a pair of integral retainer screws 200 are operatively mounted in the switch housing wall 129 and they engage recesses 201 formed in the shunting strip body 198 for retaining the shunting strip 197 in position in the switch housing. The shunting strip 197 includes a pair of integral, diametrically opposite semicircular spring switch members 202 which may be about ¼ of an inch wide and 0.020 inches thick. In use the wave springs 136 return the switch housing to the position shown in FIG. 3 so that the motor shunting strip 197 has the curved portions 202 in contact with the terminals 110 and 119. With the switch in the last mentioned position, the motor functions as a brake in order to hold the load engaged by the winch in position.

As shown in FIG. 5, the switch assembly 128 is provided with D.C. electrical energy through suitable electrical conductors 150 and 151. The conductors 150 and 151 would be color coded as red for the positive lead wire and black for the negative, or ground, lead wire. The conductors 150 and 151 are held in position in a suitable grommet 152 that is mounted in a suitable opening formed through the switch housing side wall 130. As shown in FIGS. 3*b* and 5, the inner end 156 of the lead wire 151 is connected as being soldered to a projection 160 integrally formed on a contact plate 135. As shown in FIG. 5, the inner end 155 of the other lead wire 150, is also similarly soldered to the other contact plate 135.

Figure 4:
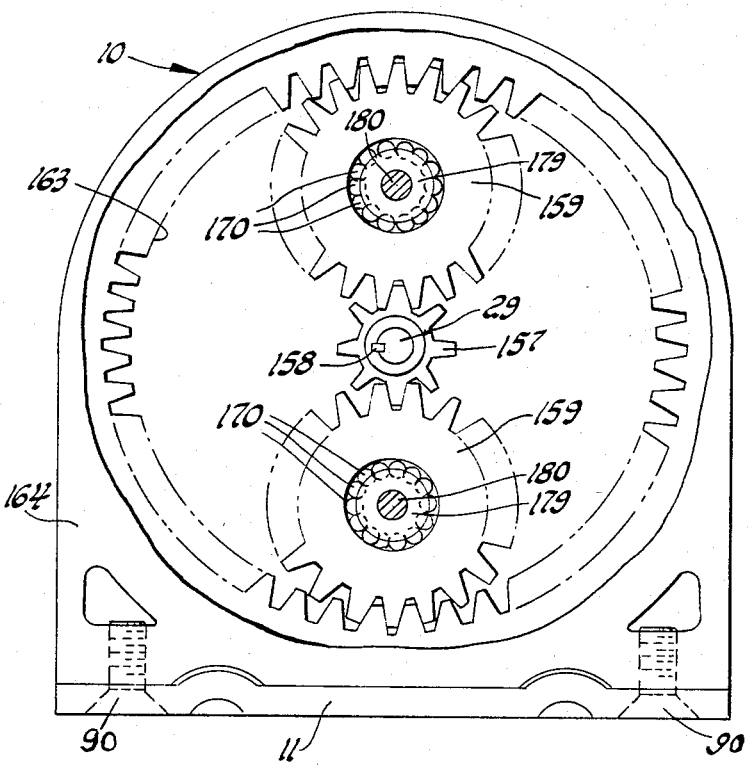
FIG. 4 is a reduced, left end view of the power winch mechanism illustrated in FIG. 3, with parts broken away and parts in section, taken substantially along the line 4—4 thereof, and looking in the direction of the arrows.

As shown in FIGS. 3 and 4, a suitable sun gear 157 is fixedly mounted by a suitable key 158 to the shaft 29 on the left end of the armature 29. The armature shaft 29 is shown in FIG. 3 as being supported by a suitable bearing 191 which is operatively mounted in a supporting sleeve 193 that is seated in a bore 195 formed in a gear housing 164. The bore 195 is enclosed by a suitable end cap 192. The end cap 192 is detachably mounted so that suitable manual wrench or other tool may be inserted in the hole 194 formed on the outer end of the shaft 29 for manually turning the winch, if desired. As shown in FIG. 3, the gear housing 164 and the support member 84 are each secured to the base plate 11 by suitable machine screws 90.

As shown in FIG. 3, the gear housing flange 15 and the gear housing 164 form a housing for a planetary gear set-up comprising the sun gear 157, a pair of planetary gear 159 and a pair of ring gears 162 and 163. The ring gear 163 is a fixed ring gear and it is integrally formed on an inner surface of the gear housing 164. The ring gear 162 is integrally formed on an inner surface of the rotatable gear housing flange 15. The gear housing flange 15 is rotatably supported by the gear housing 164 through an intermediate Z-shaped plastic bushing 166.

Figure 3A:
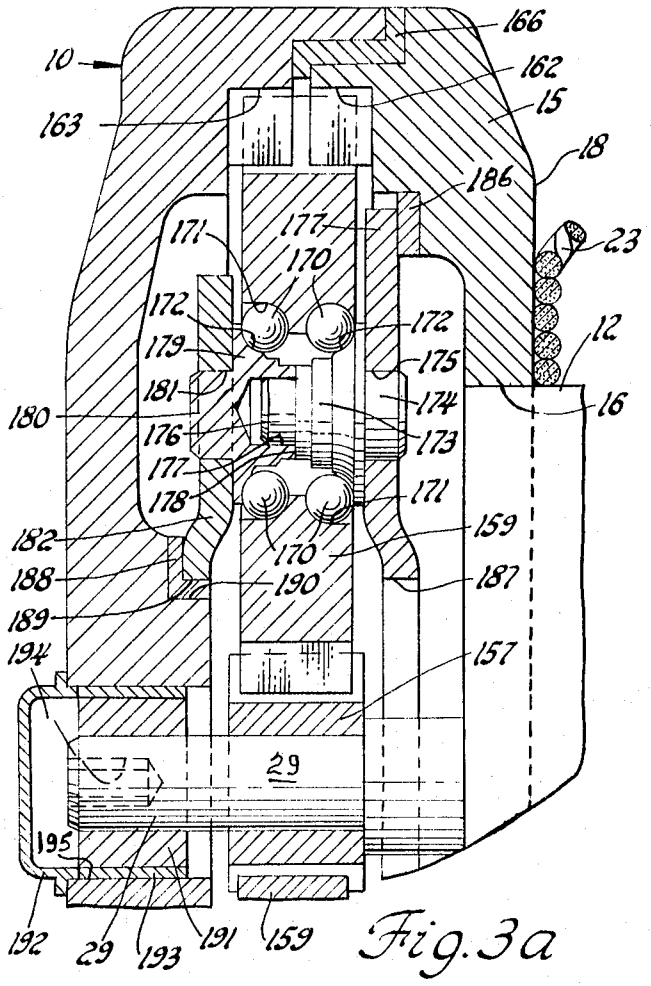
FIG. 3*a* is an enlarged view of a portion of the upper left end of FIG. 3.

Each of the planetary gears 159 is operatively mounted within the gear housing 164 of the following described structure. Each of the planetary gears 159 is provided with a pair of roller bearing races 171 which are formed in the opposite faces thereof. A plurality of roller bearings 170 are operatively mounted in the races 171 and they also engage mating races 172 (FIG. 3*a*), formed on the mating shaft members 173 and 179. The shaft member 173 has a reduced diameter shaft extension 174 that is mounted in the bore 175 formed in a circular carrier member 177. The carrier member 177 has a circular opening 187 which surrounds the shaft 29. The shaft portion 173 comprises the inner end of the planet supporting structure and the shaft portion 179 comprises the outer portion. The carrier member 177 is separated from the rotating gear housing flange 15 by a suitable bearing washer 186. The outer shaft portion 179 is provided with a reduced diameter shaft 180 which is mounted in the bore 181 in a carrier member 182. The outer shaft portion 179 has a bore 177 which receives an inner end shaft portion 176 of the inner shaft member 173. The carrier member 182 is rotatably mounted on a hub 190 formed in the inner side of the gear housing 164. A suitable L-shaped bearing 188 is positioned between hub 190 and the gear housing 164. The carrier member 182 is provided with a bore 189 which seats on a portion of the L-shaped bearing 188. The inner shaft portion 173 is provided with a shoulder 178 which limits the inward movement of the shaft 176 in the bore 177 in the outer shaft portion 179.

The rotating ring gear 162 is provided with two more teeth than the outer fixed ring gear 163. In one embodiment, the sun gear 157 is provided with eight teeth, the planetary gears 159 are provided with twenty teeth, the rotating ring gear 162 is provided with forty-eight teeth, and the fixed ring gear 163 is provided with forty-six teeth. In another embodiment, the teeth for the ring gears 162 and 163 were 10/12 stub tooth gears having a 4.800 pitch diameter and with a 25° pressure angle. The gear housing 164 may be made from any suitable material, as for example, aluminum diecast material. The rotating ring gear 162 may be made from any suitable material, as for example, a powdered metal casting. The sun gear 157 and the planetary gears 159 may be standard gears or they may be non-standard gears to mesh with the two ring gears.

In use, with the winch mechanism 10 mounted in a desired position and with the cable 19 attached to a load, the operator would turn the switch assembly 128 in either a clockwise or counterclockwise direction as desired to provide the desired rotation of the cable drum 12. As viewed in FIG. 5, it will be seen that if the switch 128 is turned and held in a clockwise direction, that the upper end of the left contact plate 135 will engage the screw terminal 110 and the lower end of the right contact plate will engage the terminal screw 119 to provide rotation in one direction. If the switch 128 is released, the wave springs 136 will return the spring to the center position shown in FIGS. 3 and 5. When the switch 128 is turned in a counterclockwise direction as viewed in FIG. 5, then the upper end of the right contact plate 135 will be brought into contact with the screw terminal 110 and the lower end of the left contact plate 135 will be brought into contact with the screw terminal 119 to provide rotation of the cable drum in the opposite direction.

It will be understood that the direction of rotation of the cable drum 12 will be a function of connecting the wires 150 and 151 in a desired polarity. It will also be understood that when the electric motor 25 rotates, that the sun gear 157 will drive the planetary gears accordingly, that is, as viewed in FIG. 4 when the sun gear 157 is rotated in a clockwise direction, then the two planetary gears 159 will also be driven in a clockwise direction around the fixed gear 163. Because of the fact that the rotating ring gear 162 has two teeth more than the fixed gear 163, the cable drum will begin rotating counterclockwise and for each revolution of the two planetary gears 159, the cable drum 12 will be provided with an incremental movement of two teeth for each revolution. The last mentioned action provides a gear reduction between the planet carrier and the cable drum 12 of 48:2.

It will be understood that the D.C. electric motor 25 may be powered by the electrical system of a four-wheeled drive vehicle when small size motors are employed, as for example, one-third horsepower motors, three-quarter horsepower motors, three horsepower motors, and the like. The winch mechanism 10 of the present invention may also be made in larger horsepower capacities. It will also be understood that a suitable A.C. motor may be employed in lieu of a D.C. motor.

While it will be apparent that the preferred embodiment of the invention herein disclosed is well calculated to achieve the results aforestated, it will be appreciated that the invention is susceptible to modification, variation and change.

INDUSTRIAL APPLICABILITY

The power winch mechanism of the present invention is adapted for use on boat trailers, on aircraft, on four-wheel drive vehicles, and in other general utility applications. The power winch mechanism of the present invention may be made in various sizes in accordance with the aforementioned uses.

We claim:

1. A power winch mechanism comprising:
(a) a rotatable magnetic cable drum;
(b) an electric motor including an armature and a permanent magnet field integral with said magnetic cable drum to combine with said magnetic cable drum to form a complete magnetic circuit:
(c) a base plate;
(d) means for rotatably mounting one end of said magnetic cable drum on said base plate;
(e) means carried by said magnetic cable drum for rotatably mounting one end of said electric motor armature;
(f) a gear housing mounted on said base plate and rotatably supporting the other end of said magnetic cable drum and the other end of said electric motor armature;
(g) a planetary gear type reduction unit operatively mounted in said gear housing and drivably connecting said other end of said electric motor armature to said other end of said magnetic cable drum with diametrically opposed, substantially co-planar, and equal driving forces;
(h) brush means operatively engaged with said electric motor armature and magnetic cable drum; and,
(i) switch means operatively connected to said brush means for conveying and controlling electrical energy through said brush means to said electric motor armature for operating said electric motor armature in a pre-determined direction of rotation to rotate said magnetic cable drum.

2. A power winch mechanism as defined in claim 1 wherein said gear reduction unit comprises:
(a) a fixed ring gear integral with said gear housing;
(b) a rotatable ring gear integral with said magnetic cable drum for rotation with said magnetic cable drum;
(c) a sun gear operatively mounted on said other end of said electric motor armature; and,
(d) a planetary gear set operatively meshed with said sun gear and said ring gears.

3. A power winch mechanism as defined in claim 2, wherein:
(a) the number of teeth on the rotatable ring gear is not equal to the number of teeth on the fixed ring gear.

4. A power winch mechanism as defined in claim 3, wherein said planetary gear set comprises:
(a) a carrier means rotatably mounted in said gear housing;
(b) a plurality of planet gears; and,
(c) means for rotatably mounting each of said planet gears on said carrier means.

5. A power winch mechanism as defined in claim 4, wherein:
(a) said means for rotatably mounting each of said planet gears on said carrier means comprises a bearing means.

6. A power winch mechanism as defined in claim 3, wherein said brush means comprises:
(a) a first brush means carried by said magnetic cable drum and rotatable therewith and operatively engageable with said electric motor armature; and,
(b) a second brush means carried in said means for mounting one end of said magnetic cable drum on said base plate and being fixed against rotation and operatively engageable with said first brush means.

7. A power winch mechanism as defined in claim 6, wherein:
(a) said switch means is operatively connected to said second brush means.

8. A power winch mechanism as defined in claim 7, wherein:
(a) said first brush means includes a pair of annular contact plates; and,
(b) said second brush means includes a first set of contact buttons for operative engagement with a first one of said pair of annular contact plates, and a second set of contact buttons for operative engagement with a second one of said pair of annular contact plates.

9. A power winch mechanism as defined in claim 8, wherein:
(a) said second brush means includes spring means for normally biasing said contact buttons into operative engagement with said pair of annular contact plates.

10. A power winch mechanism as defined in claim 7, wherein:
(a) said second brush means includes a pair of terminals;
(b) said switch means includes a pair of contact plates movably positioned on opposite sides of said pair of terminals; and,
(c) each of said contact plates being operatively connected to a separate lead wire for connection to a source of D.C. power.

11. A power winch mechanism as defined in claim 10, wherein said switch means further includes:
(a) spring means operatively engaged with said contact plates for normally moving said contact plates into inoperative positions spaced apart from said pair of terminals, whereby when said switch means is rotatably turned by a turning force in one direction, one of the contact plates will be moved to engage a first one of said terminals and the other one of the contact plates will be moved to engage a second one of said terminals, and said contact plates will be moved back to said inoperative position spaced apart from said pair of terminals when the turning force is released from the switch means.

12. A power winch mechanism as defined in claim 11, including:

(a) said spring means further includes a shunting strip means for electrically connecting said pair of terminals when the switch mechanism is turned to the inoperative position wherein the pair of contact plates are spaced apart from the pair of terminals.

* * * * *